US008814154B2

(12) United States Patent
Woods

(10) Patent No.: US 8,814,154 B2
(45) Date of Patent: Aug. 26, 2014

(54) CLAMP ASSEMBLY

(75) Inventor: Raymond K. Woods, Traverse City, MI (US)

(73) Assignee: Clamp-Plus, LLC, Northport, MI (US)

( * ) Notice: Subject to any disclaimer, the term of this patent is extended or adjusted under 35 U.S.C. 154(b) by 415 days.

(21) Appl. No.: 13/191,931

(22) Filed: Jul. 27, 2011

(65) Prior Publication Data

US 2012/0032386 A1 Feb. 9, 2012

Related U.S. Application Data

(60) Provisional application No. 61/370,535, filed on Aug. 4, 2010.

(51) Int. Cl.

| | |
|---|---|
| ***B25B 1/14*** | (2006.01) |
| ***B25B 1/04*** | (2006.01) |
| ***B25B 5/12*** | (2006.01) |
| ***B25B 5/16*** | (2006.01) |

(52) U.S. Cl.
CPC .. *B25B 5/12* (2013.01); *B25B 5/163* (2013.01)
USPC ..... 269/238; 269/228

(58) Field of Classification Search
USPC ..... 269/32, 24, 27, 228, 120
See application file for complete search history.

(56) References Cited

U.S. PATENT DOCUMENTS 3,872,760 A * 3/1975 Desnoyers, Jr. ..... 83/743
4,335,873 A * 6/1982 Kiefer ..... 269/228

* cited by examiner

*Primary Examiner* — Lee D Wilson
*Assistant Examiner* — Nirvana Deonauth
(74) *Attorney, Agent, or Firm* — Gifford, Krass, Sprinkle, Anderson & Citkowski, P.C.

(57) ABSTRACT

A clamp assembly having a base and an elongated clamp arm having one end pivotally mounted to the base. An elongated lever is pivotally secured to both the base and the clamp arm and movable between a first and second position which simultaneously pivots the clamp arm along a direction of movement between a hold position and a release position. A bolt retainer is attached to the free end of the clamp arm. The bolt retainer includes an internally threaded bore having an axis which extends substantially parallel to the direction of movement of the clamp arm. A bolt includes a portion threadably engaged in the threaded bore so that the effective length of the bolt is adjustable by rotation of the bolt in the bolt retainer bore.

7 Claims, 1 Drawing Sheet

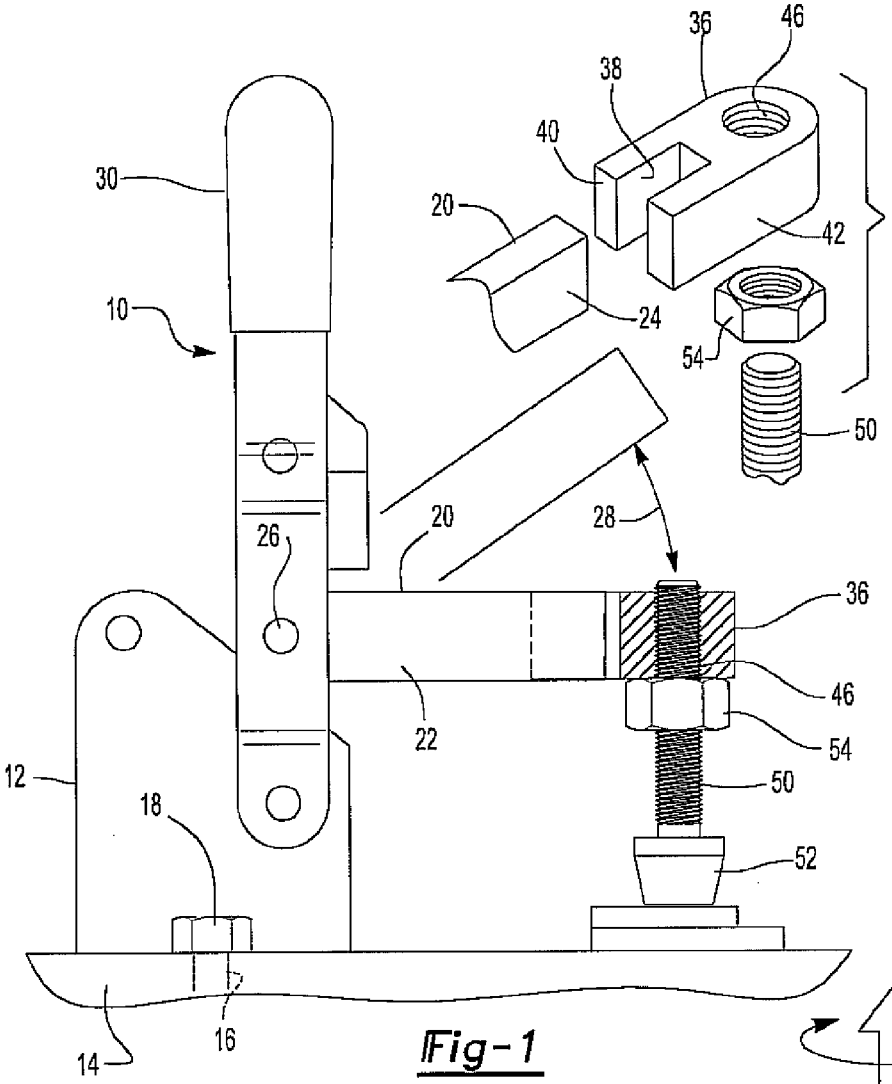
Fig-1
Fig-2
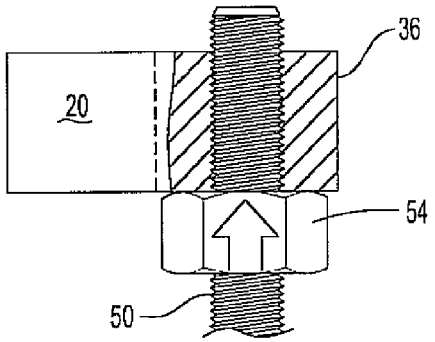
Fig-4
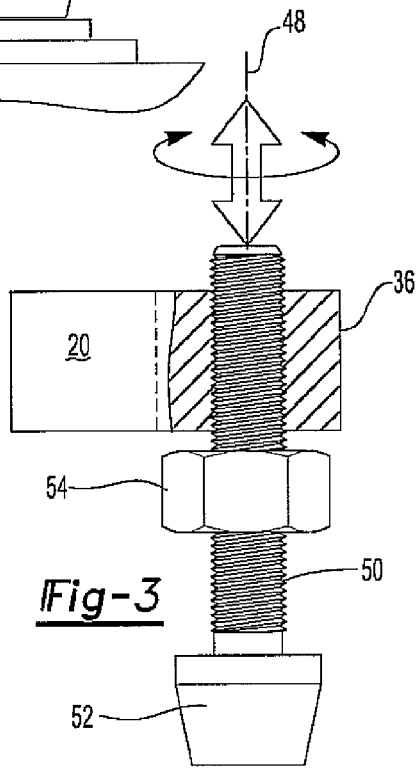
Fig-3

CLAMP ASSEMBLY

CROSS REFERENCE TO RELATED APPLICATIONS

This application claims priority of U.S. Provisional Patent Application Ser. No. 61/370,535 filed Aug. 4, 2010, which is incorporated herein by reference.

BACKGROUND OF THE INVENTION

I. Field of the Invention

The present invention relates to clamp assemblies and, more particularly, to a quick release clamp assembly having an adjustable bolt.

II. Description of Related Art

There are many previously known lever-operated clamps that are used for temporarily clamping items to a structure. For example, such clamps are oftentimes used for assembly work in order to properly secure and position pieces for assembly during the assembly process.

These previously known lever-operated clamps typically include a base which is secured to a substructure or support of some sort. One end of an elongated clamping arm is pivotally mounted to the base so that the clamping arm is movable along a direction of movement between a hold position and a release position. An elongated lever is then pivotally mounted to both the base as well as the clamping arm. This lever is movable between a first position and a second position which simultaneously moves the clamp arm from its hold position and release position.

Conventionally, an elongated bolt is adjustably mounted to a free end of the clamp arm so that a free end of the bolt is adjustable relative to the clamped surface. Oftentimes, a resilient or elastomeric cap is provided on the free end of the bolt in order to protect the work being clamped from marring or other damage.

In order to attach the bolt to the free end of the clamp arm, these previously known clamp assemblies, oftentimes called quick release clamp assemblies, include an elongated bore. The bore is formed at the free end of the clamp arm so that the axis of the bore is substantially parallel to the direction of movement of the clamp arm.

These previously known clamp assemblies typically slide the bolt attached to the cap through a hole at the end of the clamp arm. A first nut is then positioned below the clamp arm while a second nut is positioned above the clamp arm and both nuts threadably engage the bolt. Consequently, rotation of the bolt relative to the nuts adjusts the position of the cap relative to the clamp arm and thus adjusts the distance between the bolt cap and the workpiece when the clamp arm is moved to its hold position. Furthermore, the relative position of the bolt relative to the clamp arm along the direction of movement is adjustable by adjusting the rotation of the nuts on the bolt.

One disadvantage of this previously known adjustment mechanism for the clamp assembly, however, is that it is relatively difficult and awkward to quickly and/or accurately adjust the position of the bolt relative to the clamp arm. This difficulty results, in large part, since both nuts, i.e. the nut on top of the clamp arm and the nut on the bottom of the clamp arm, must simultaneously be adjusted in order to change the length of the bolt relative to the clamp arm.

Clamp assemblies of the above-described type are manufactured by a company known as DeStaCo as well as other companies.

SUMMARY OF THE PRESENT INVENTION

The present invention provides a clamp assembly which overcomes all of the above-mentioned disadvantages of the previously known clamp assemblies.

In brief, the clamp assembly of the present invention includes a base designed to be attached to a substructure or support of some sort. For example, the base may include screw holes to receive fastening screws for fastening the base to the support.

An elongated clamp arm includes a first and a second spaced apart end. The first end of the clamp arm is pivotally secured to the base so that a clamp arm is pivotal between a hold position and a release position along a predetermined direction of movement.

An elongated lever is then pivotally connected to both the base and the clamp arm. The lever is movable between a first position and a second position which simultaneously pivots the clamp arm between the release position and the hold position along the direction of movement.

A bolt retainer is attached to the second end of the clamp arm. This bolt retainer includes an internally threaded through bore having an axis which extends substantially parallel or tangential to the direction of movement of the clamp arm. An elongated bolt is then threadably secured within the bolt retainer internally threaded bore so that the effective length of the bolt may be adjusted by rotating the bolt relative to the bolt retainer. A resilient or elastomeric bumper is also preferably attached to the free end of the bolt while a single jam nut threadably mounted to the bolt compresses against the clamp arm upon tightening thus preventing further rotation of the bolt.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 1 is a side view illustrating a preferred embodiment of the present invention;

FIG. 2 is a fragmentary, exploded elevational view of the preferred embodiment of the invention;

FIG. 3 is a view illustrating the adjustability of the bolt relative to the clamp arm; and FIG. 4 is a view similar to FIG. 3, but illustrates the bolt in a locked position.

DETAILED DESCRIPTION OF A PREFERRED EMBODIMENT OF THE PRESENT INVENTION

With reference first to FIG. 1, a preferred embodiment of a clamp assembly 10 according to the present invention is shown. The clamp assembly 10 includes a base 12 constructed of a rigid material, such as metal.

The base 12 is adapted for attachment to a structure or support 14 so that the base 12 and structure 14 are fixed relative to each other. Any conventional means may be used to secure the base 12 to the support 14. However, as illustrated in the drawing, the base 12 includes one or more screw openings 16 dimensioned to receive fastening screws 18 which extend into the support 14.

As best shown in FIG. 1, an elongated clamp arm 20 has two spaced apart ends 22 and 24. The clamp arm 20 is preferably constructed of metal bar stock and thus has a generally rectangular cross-sectional shape. Preferably, the clamp arm 20 is made of steel.

The first end 22 of the clamp arm 20 is pivotally mounted to the base 12 by a pivot pin 26. The pivot pin 26 thus allows the clamp arm to pivot about the pivot pin 26 along a direction of movement 28 between a release position, illustrated in phantom line, and a hold position, illustrated in solid line.

In order to pivot the clamp arm 20 between its hold and release positions, an elongated lever 30 is pivotally mounted to both the base 12 and the clamp arm 20 so that the lever is movable between a first position, illustrated in phantom line in FIG. 1, and a second position, illustrated in solid line in FIG. 1. Furthermore, as the lever 30 moves from its first and to its second position, the lever simultaneously moves the clamp arm from its release and to its hold position.

With reference now to FIGS. 1 and 2, a bolt retainer 36 is attached to the second end 24 of the clamp arm 20 in any conventional fashion, such as by welding, adhesive, fasteners, or the like. The bolt retainer 36 is constructed of a rigid material, such as metal, and is preferably of a one piece construction. The bolt retainer 36 includes a channel 38 formed by two side walls 40 and 42. The width of the channel 38, furthermore, preferably conforms to the thickness of the clamp arm 20 so that with the bolt retainer 36 positioned over the second end 24 of the clamp arm 20, the side walls 40 and 42 of the bolt retainer 36 frictionally engage opposite sides of the clamp arm 20.

The bolt retainer 36 also includes an internally threaded bore 46 which is preferably a through bore having an axis 48.

The bolt retainer 36 is positioned on the end 24 of the clamp arm 20 such that the axis 48 of the bore 46 is parallel to the direction of movement 28 of the clamp arm 20 as it moves between its hold and release positions. Furthermore, as used herein, the term "parallel" shall include tangential when applied to an arcuate direction of movement 28 of the clamp arm 20. Alternatively, the axis of the bore 46 may be oblique or angled relative to the direction of movement 28.

With reference now to FIGS. 3 and 4, an elongated bolt 50 is externally threaded so that the bolt 50 threadably engages the bolt retainer threaded bore 46. As such, the length or extension of the bolt 50 from the clamp arm 20 is easily adjustable by simple rotation of the bolt 50 in the threaded bore 46 as best shown in FIG. 3. Rotation of the bolt 50 relative to the bolt retainer 36 in one direction increases the extension of the bolt 50 from the clamp arm 20 and vice versa.

A bumper 52, preferably made of a resilient or elastomeric material, is preferably attached to a free end of the bolt 50. This bumper 52 protects the work from marring or other damage when the bumper 52 is compressed against the work when the clamp arm is in its hold position.

In order to lock the bolt 50 against rotation in its adjusted position, a jam nut 54 is threadably mounted around the bolt 50. Upon tightening of the jam nut 54 as shown in FIG. 4, the jam nut 54 compresses against the bolt retainer 36 and simultaneously compresses against the threads on the bolt 50 to lock the bolt 50 against further rotation. Further adjustment of the bolt 50 is, of course, permissible upon loosening of the jam nut 54. Furthermore, although the jam nut 54 is illustrated in the drawing as positioned between the bumper 52 and the bolt retainer 36, it may alternatively be positioned on the opposite side of the bolt retainer 36 and still operate in the same fashion.

It can thus be seen that the present invention provides a simple, yet effective, clamp assembly of the quick release type in which the position of the clamping member, i.e. the bolt 50 with its bumper 52, may be easily, accurately, and quickly adjusted. Having described my invention, however, many modifications thereto will become apparent to those skilled in the art to which it pertains without deviation from the spirit of the invention as defined by the scope of the appended claims.

I claim:

1. A clamp assembly comprising:

a base, a clamp arm having a first and a second spaced apart end, said first end of said first clamp arm being pivotally secured to said base, an elongated lever pivotally connected to both said base and said clamp arm, said lever movable between a first and a second position which simultaneously pivots said clamp arm along a direction of movement between a hold position and a release position, a bolt retainer having a one piece construction and fixedly attached to said second end of said clamp arm, wherein at least a portion of said clamp arm is positioned within a receiving channel of said bolt retainer, said bolt retainer having an internally threaded bore, and a bolt having a portion threadably engaged in said threaded bore so that said bolt moves in unison with said clamp arm as said clamp arm moves along said direction of movement.

2. The clamp assembly defined in claim 1 and comprising a nut threadably mounted to said bolt so that, upon tightening, said nut compresses against said bolt retainer.

3. The clamp assembly defined in claim 1 and comprising an elastomeric bumper mounted to one end of said bolt.

4. The clamp assembly defined in claim 1 wherein said bolt retainer is welded to said lever.

5. The clamp assembly defined in claim 1 wherein said lever clamp arm comprises a flat bar and wherein said bolt retainer includes a said receiving channel formed by two spaced apart side walls, said receiving channel dimensioned to receive a portion of said flat bar so that said side walls abut on opposite sides of said flat bar.

6. The clamp assembly defined in claim 1 wherein said bolt retainer is made of metal.

7. The clamp assembly defined in claim 1 wherein said threaded bore is a through bore which extends entirely through said bolt retainer.

* * * * *